US008353541B2

(12) United States Patent
Minter

(10) Patent No.: US 8,353,541 B2
(45) Date of Patent: Jan. 15, 2013

(54) LOCK MECHANISM FOR A CASEMENT WINDOW

(75) Inventor: Peter Minter, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 1028 days.

(21) Appl. No.: 12/194,314

(22) Filed: Aug. 19, 2008

(65) Prior Publication Data

US 2010/0043504 A1 Feb. 25, 2010

(51) Int. Cl.
*E05C 1/02* (2006.01)

(52) U.S. Cl. ..... 292/137; 292/158

(58) Field of Classification Search ..... 292/35, 292/119, 135, 97, 158, 166, DIG. 21, DIG. 33, 292/DIG. 51
See application file for complete search history.

(56) References Cited

U.S. PATENT DOCUMENTS

| | | | | |
|---|---|---|---|---|
| 2,708,478 | A | 5/1955 | Wolf et al. | |
| 2,883,225 | A | 4/1959 | Akehurst | |
| 4,362,328 | A | 12/1982 | Tacheny et al. | |
| 4,803,808 | A | 2/1989 | Greisner | |
| 5,090,750 | A | 2/1992 | Lindqvist | |
| 5,219,195 | A * | 6/1993 | Lawrence | 292/336.3 |
| 5,318,333 | A | 6/1994 | Dreifert | |
| 5,370,428 | A | 12/1994 | Dreifert et al. | |
| 5,595,408 | A | 1/1997 | Jeche | |
| 5,806,353 | A | 9/1998 | Pages | |
| 6,450,554 | B1 | 9/2002 | Rotondi et al. | |
| 6,651,389 | B2 * | 11/2003 | Minter et al. | 49/394 |
| 2008/0001413 | A1 * | 1/2008 | Lake et al. | 292/138 |

OTHER PUBLICATIONS

One Hand Operation Fittings, WW Kurier-GLS, edition Jan. 1989, pp. 3,5,7 & 11, Germany.
Espangnolettes for Outward Opening Windows,Roto advertisement, Edition Jan. 1990.

* cited by examiner

*Primary Examiner* — Gary Estremsky
(74) *Attorney, Agent, or Firm* — DeLio & Peterson, LLC

(57) ABSTRACT

The invention relates to a lock mechanism for a casement window having a keeper adapted to be attached to a sash, a lockbar adapted to be attached to a frame for engaging with the keeper to lock the casement window, and an actuator for actuating the lockbar to engage with the keeper. The actuator includes a fork having a V shaped groove, the V shaped groove includes a first leg and a second leg, and the actuator includes a switch having a channel for placement of a drive pin. The switch is rotatably mounted at a juncture of the first and second legs so that the channel generally aligns with either the first leg or the second leg for facilitating alignment of the drive pin within the V shaped groove.

14 Claims, 19 Drawing Sheets

LOCK MECHANISM FOR A CASEMENT WINDOW

FIELD OF THE INVENTION

The invention relates to a lock mechanism for a casement or swinging window.

BACKGROUND OF THE INVENTION

A lock mechanism for locking a casement window, wherein a pivotable sash containing a pane of glass is to be closed against a window frame, typically includes one or more locking rods or lockbars that are laterally movable between a retracted and extended position for inserting and removing an outer end of the bar into and out of engagement with the sash.

Some lock mechanisms may include a laterally movable or rotatable handle or knob directly coupled to the inner end of the lockbar for moving the lockbar between the extended and retracted positions as the handle is slid or rotated. The direct coupling between the lockbar inner end and the knob or handle typically has the end of the lockbar rotatably pinned to the handle. In other direct coupling lock mechanisms, an intermediate link may be placed where one end is pinned to the lockbar and the other end is pinned to the handle or knob.

A possible disadvantage of the prior art lies in the direct mechanical linkage, which can often be difficult to extend and retract because of inherent friction or resistance in the mechanical linkages. Many of the mechanical linkages over time may change angular orientation with respect to the handle or knob as it is rotated, resulting in relatively large and varying rotational forces to be applied to the handle or knob to affect the extension or retraction. The magnitude and varying nature of the operational force sometimes result in jerky operation and perhaps a very high initial force. The combination of these effects can often lead to difficulty in operating the window lock and possibly failure of the window lock.

Other lock mechanisms may include lockbars along an edge of a window frame to lock a sash against the frame. The lockbars typically have a plurality of rollers mounted on the lockbar that engage ramped keepers spaced along the edge of the window sash. The rollers and keepers are usually spaced so that the rollers engage the keepers in a sequential manner, starting from the bottom of the sash and ending with the top of the sash. As a result, the bottom of the sash is normally locked first and the sequential interaction of the middle and top rollers with the middle and top keepers respectively results in the middle and top portions of the sash being pulled against the frame and locked shut.

However, these locking mechanisms may be difficult to install because the spacing between the handle or actuator from the tie bar can vary depending upon the manufacturer and window style. As a result, some locks are usable only with certain styles of windows and other window styles require that locks be specifically manufactured for that style. Therefore, manufacturing costs can be quite high and the wide variety of locks that are required requires builders to maintain undesirably large inventories of such locks.

What is desired, therefore, is a lock mechanism for a casement window that can easily be installed on a variety of window designs. Another desire is a lock mechanism that is easy to operate by a user without expending an inordinate amount of energy by the user.

SUMMARY OF THE INVENTION

Bearing in mind the problems and deficiencies of the prior art, it is therefore an object of the present invention to provide a lock mechanism that may be installed on a variety of window designs and sizes.

It is another object of the present invention to provide a lock mechanism that is easily installed with minimal components and minimal difficulty.

A further object of the invention is to provide a lock mechanism that functions properly with minimal effort by the user over a life of the lock mechanism.

Still other objects and advantages of the invention will in part be obvious and will in part be apparent from the specification.

The above and other objects, which will be apparent to those skilled in the art, are achieved in the present invention which is directed to a lock mechanism for a casement window having a keeper adapted to be attached to a sash, a lockbar adapted to be attached to a frame for engaging with the keeper to lock the casement window, and an actuator for actuating the lockbar to engage with the keeper. The actuator includes a fork having a V shaped groove, the V shaped groove includes a first leg and a second leg, and the actuator includes a switch having a channel for placement of a drive pin. The switch is rotatably mounted at a juncture of the first and second legs so that the channel generally aligns with either the first leg or the second leg for facilitating alignment of the drive pin within the V shaped groove In some embodiments, the actuator further includes a back case having an S shaped notch and the switch has a post on a side of the switch opposite the channel, the post being placed within the S shaped notch. In other embodiments, the drive pin moves within the first leg, second leg, and channel contemporaneously as the post moves within the S shaped notch. In another embodiment, a location of the post within the S shaped notch determines a rotation of the switch and a general alignment of the channel with the first leg and the second leg.

In a further embodiment, the lock mechanism includes a guide having an aperture through which the lockbar passes for facilitating engagement of the lockbar with the keeper. In another embodiment, the guide has a hole through which a fastener passes to fasten the guide to the frame and the guide also has a longitudinal axis that is spaced apart from a center of the hole In yet another embedment, the guide has at least one stabilizer extending from the hole for inhibiting rotation of the guide. In other embodiments, the aperture of the guide has at least one bump for engaging the lockbar and the keeper has at least one ramp for engaging with the lockbar.

In another aspect of the invention, at least one part of the guide is placed within a part of the frame for minimizing fasteners for fastening the guide, adding strength, and inhibiting movement of the guide. In some embodiments, the lock mechanism includes a plurality of covers for covering at least the actuator, and wherein each cover is interchangeable with a next cover. In other embodiments, the lock mechanism includes a handle connected to the lockbar for actuating the lockbar to engage with the keeper. In some of these embodiments, a plurality of handles are provided wherein each handle is interchangeable with a next handle.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE DRAWINGS

Figure 1:
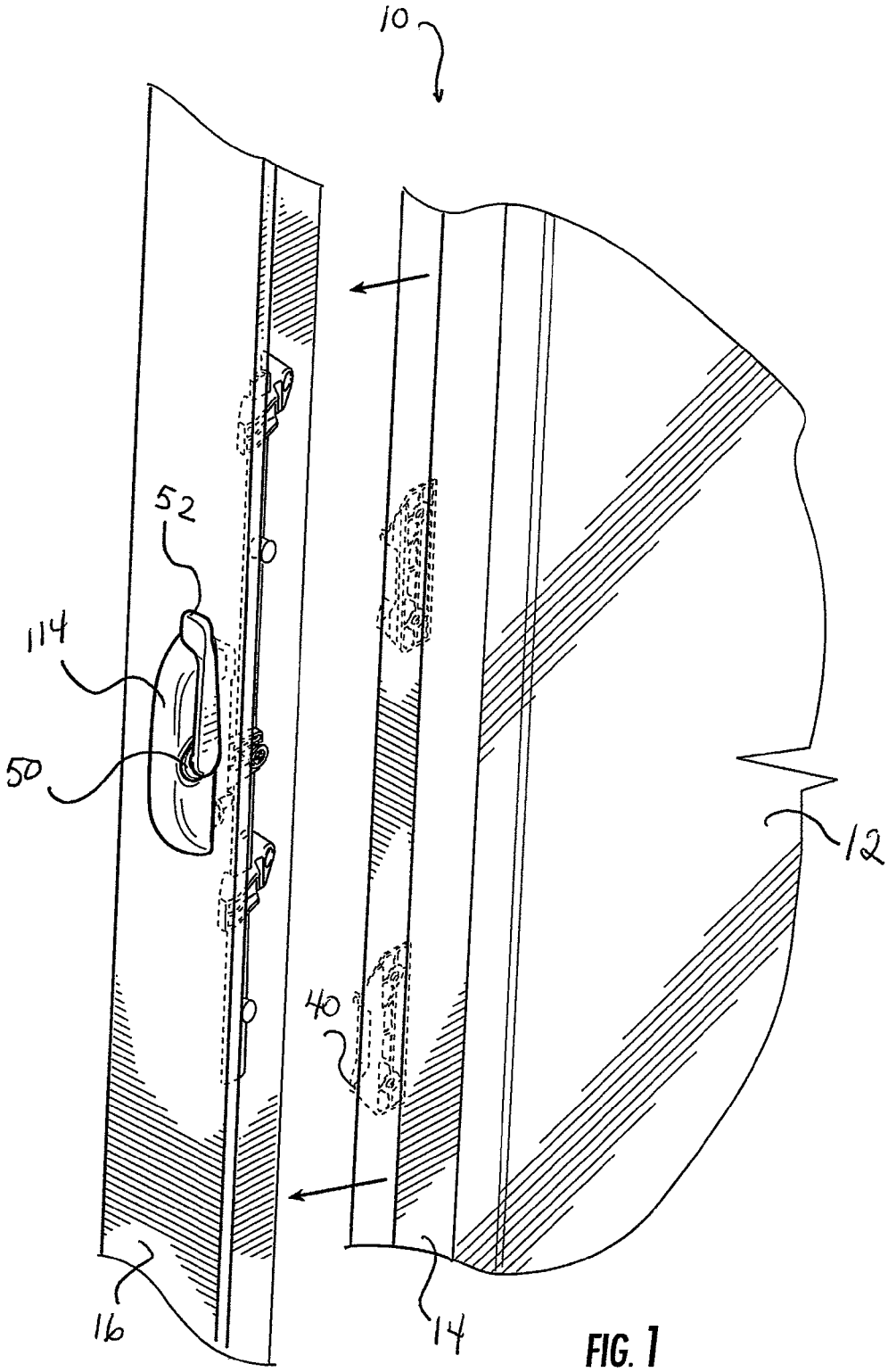
FIGS. 1-2*a* depict the lock mechanism in accordance with the invention.

As shown in FIGS. 1-2, 3-4, lock mechanism 10 includes lockbar 20, guide 30 for guiding a movement of lockbar 20, keeper 40 for engaging with lockbar 20 to close window 12, and actuator 50 for actuating lockbar 20 to engage with keeper 40.

As shown, keeper 40 is attached to sash 14 and the actuator 50, guide 30, and lockbar 20 are all attached to frame 16. Lock mechanism 10 tightly holds sash 14 and frame 16 together when they are brought together and a user actuates actuator 50.

Actuator 50 includes handle 52 where movement of handle 52 causes lockbar 20 to move along axis 31 passing through aperture 32 of guide 30. As a result of movement of lockbar 20, roller 22 also moves and, when coming in contact with keeper 40 and more particularly ramp 42, continued movement of handle 52 by a user will cause roller 22 to roll upon and along ramp 42 until it reaches plateau 44 (see FIGS. 8*a*-8*b*).

Figure 2:
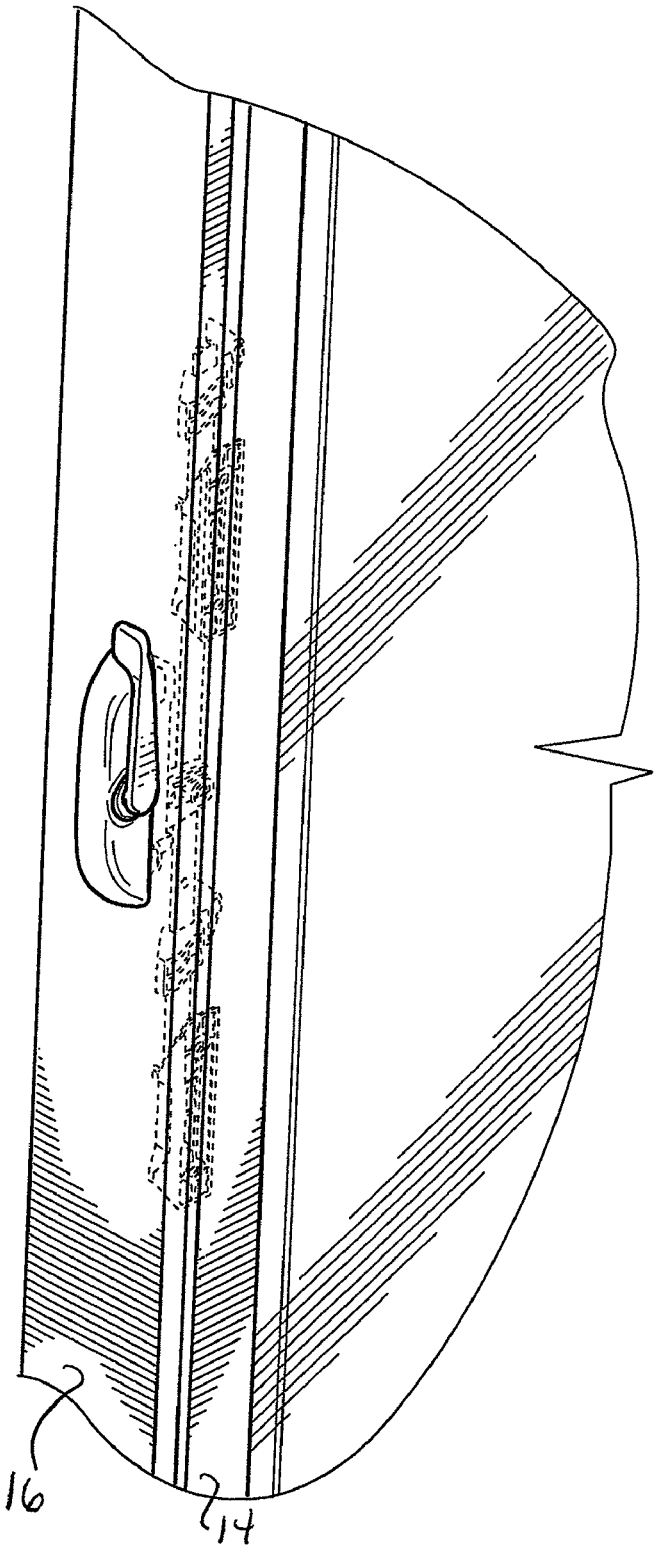
Figure 2A:
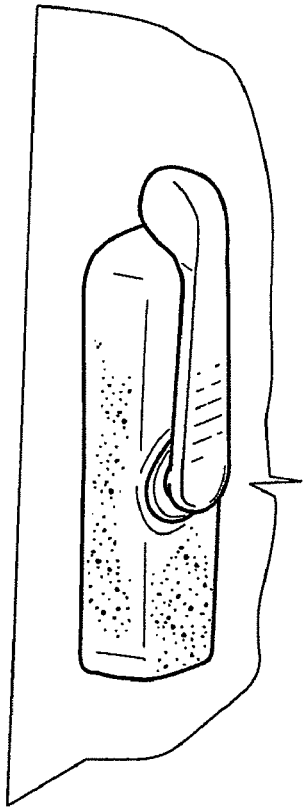
Figure 3:
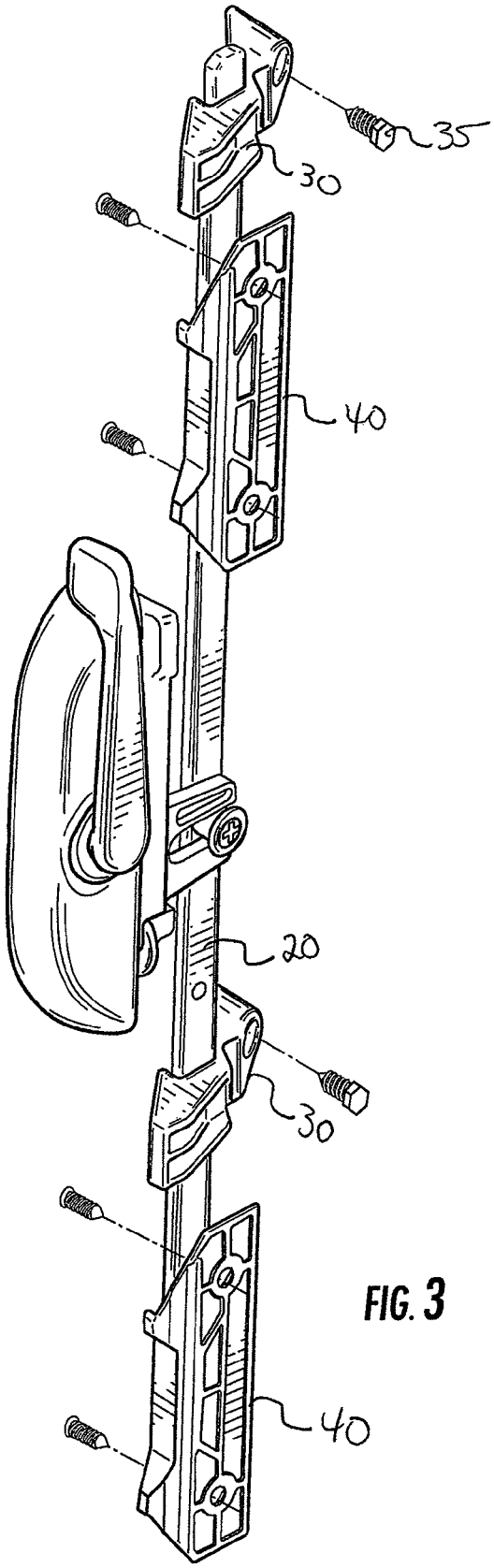
FIGS. 3-4 depict perspective views of the lock mechanism shown in FIG. 1.
Figure 4:
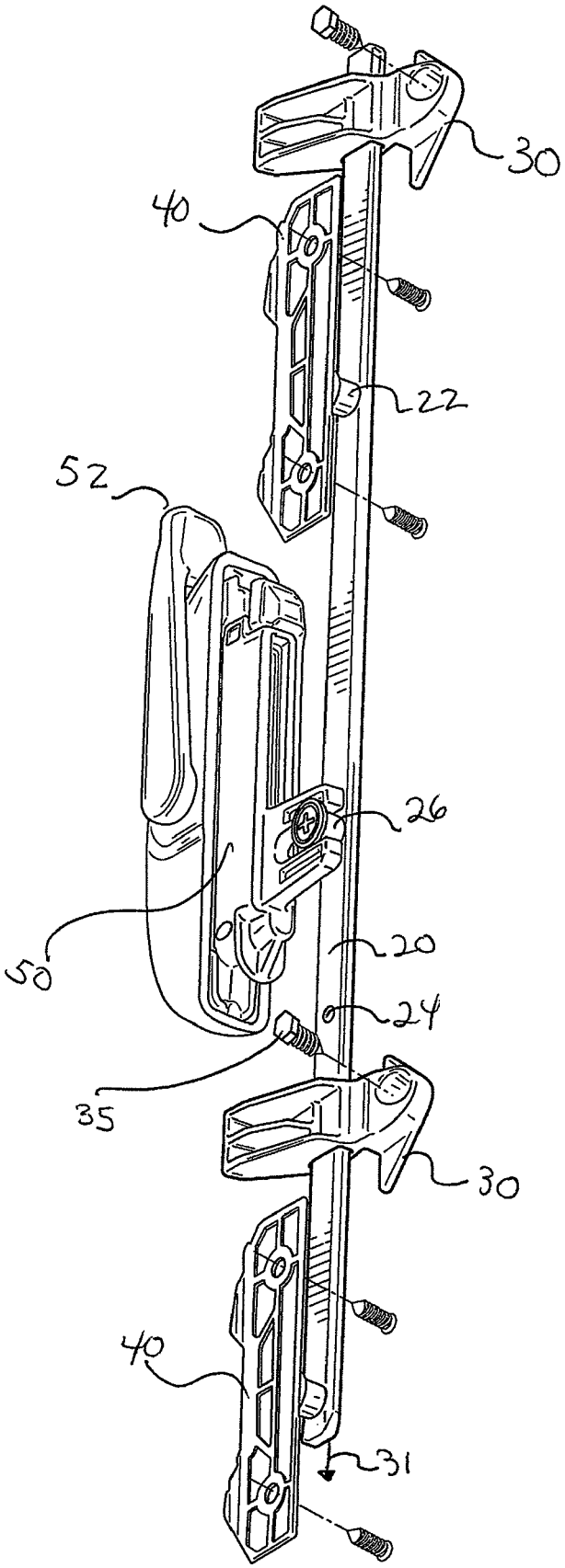
Figure 5:
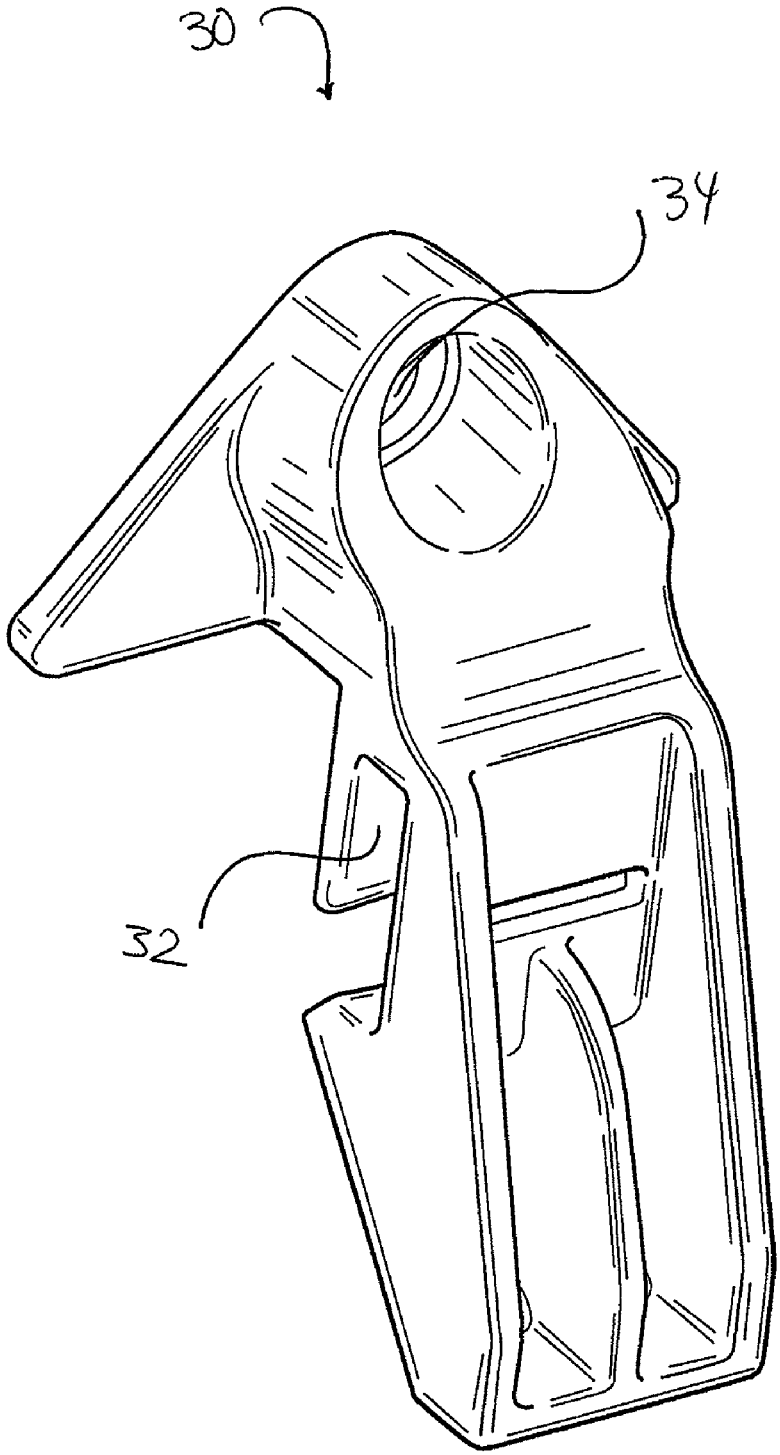
FIGS. 5-7 more particularly depict the guide shown in FIG. 1.
Figure 8A:
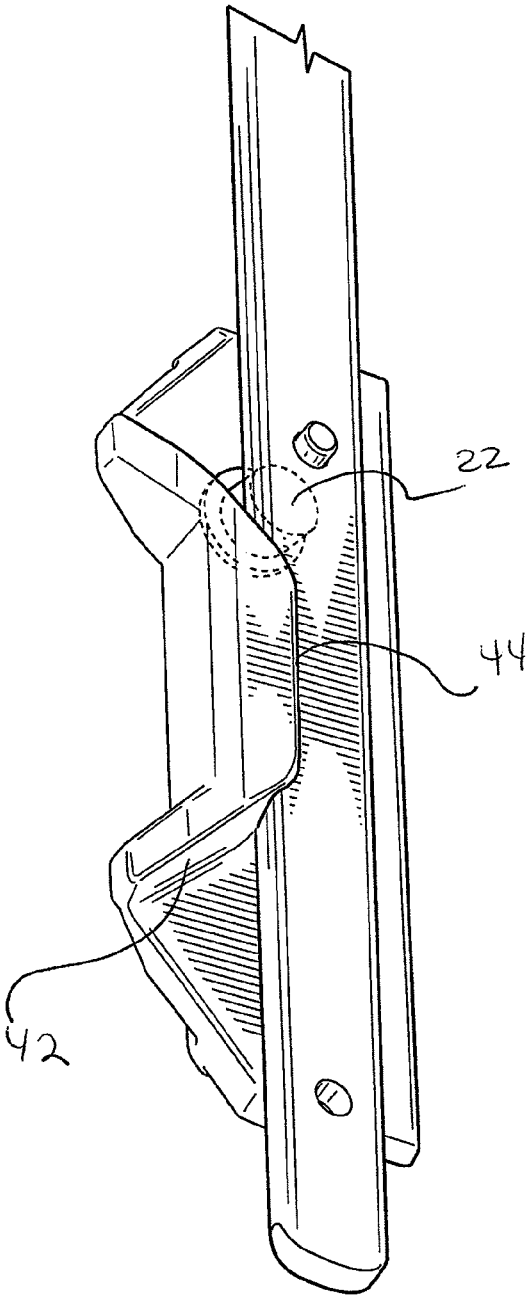
FIGS. 8*a*-8*b* more particularly depict the keepers shown in FIG. 1.
Figure 8B:
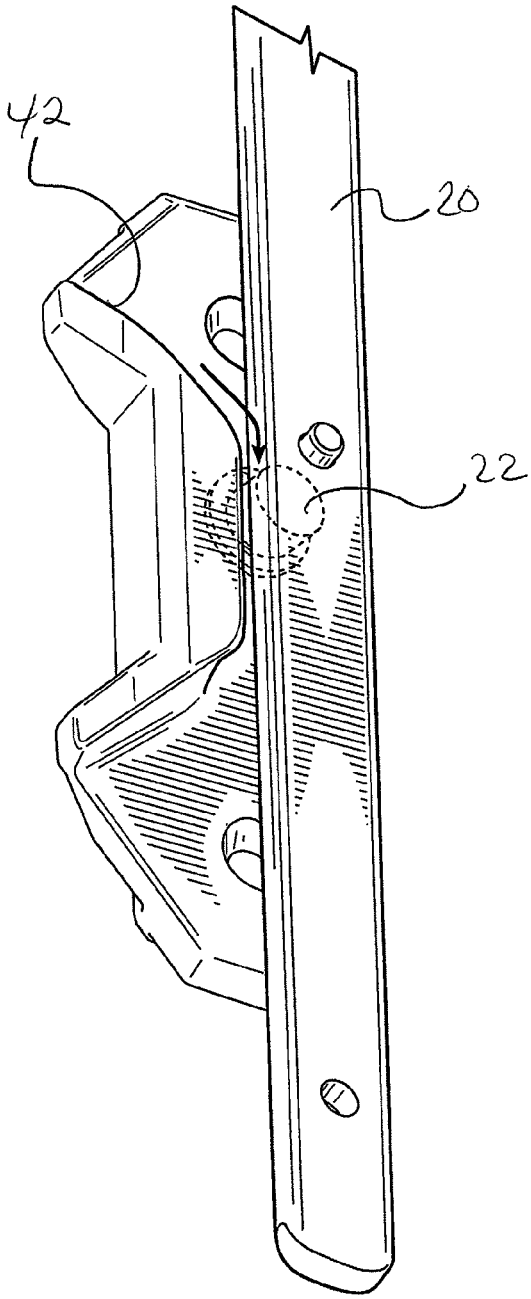

As shown in FIGS. 2 and 8*a*-8*b*, window 12 is more tightly secured when roller 22 reaches plateau 44, and reaching plateau is facilitated by ramp 42. Although two ramps and two rollers, each being rotatably attached to lockbar 20, are shown, other embodiments utilize multiple rollers and multiple keepers.

Referring to FIGS. 5-7 and 21, guide 30 is more particularly shown to include aperture 32 through which lockbar 20 passes for facilitating engagement of lockbar 20 with keeper 40 and, more particularly, for engagement of roller 22 with ramp 42 and plateau 44.

Figure 24:
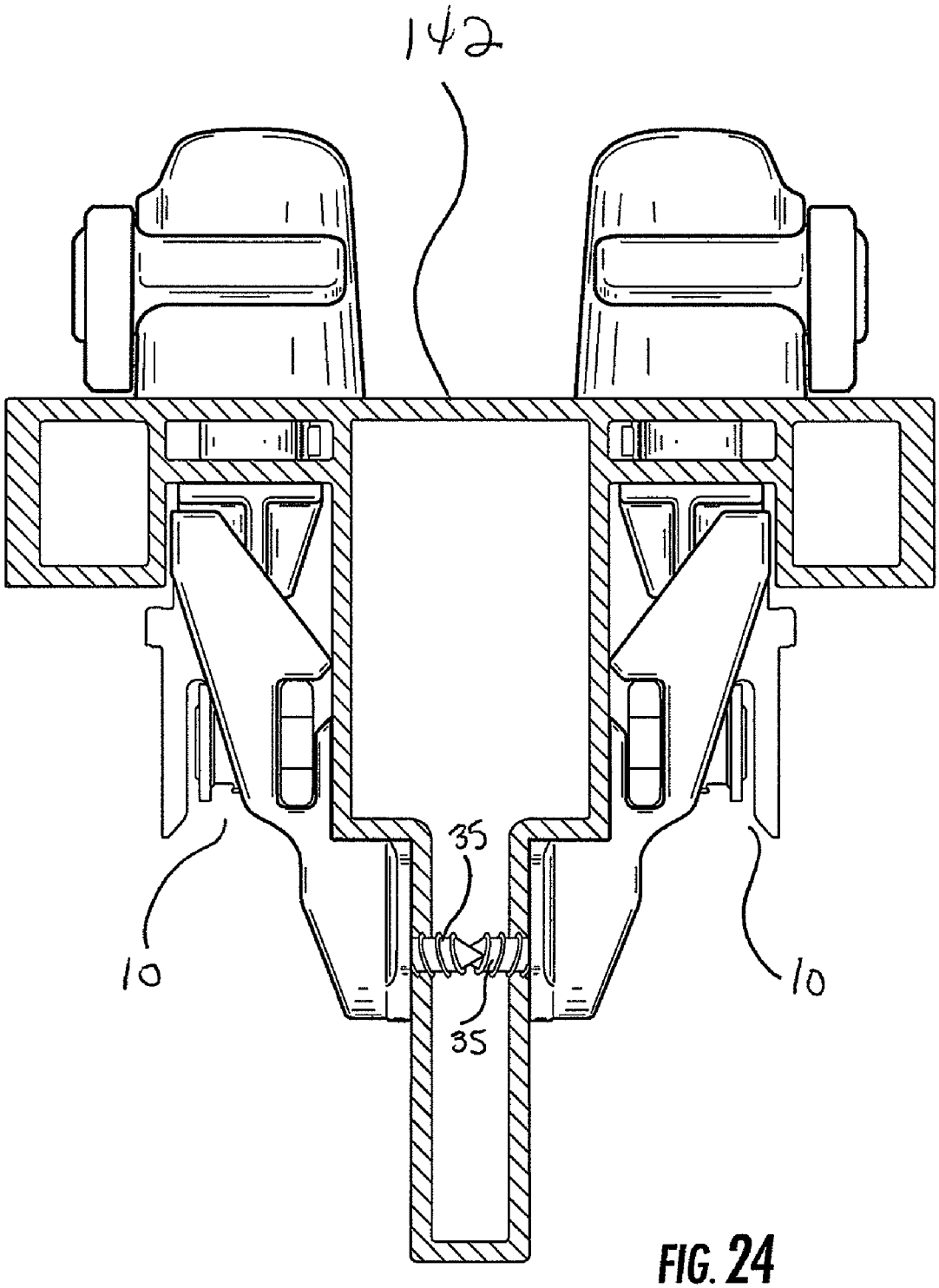
FIGS. 24-26 more particularly depict a pair of guides as shown in FIGS. 5-7.
Figure 25:
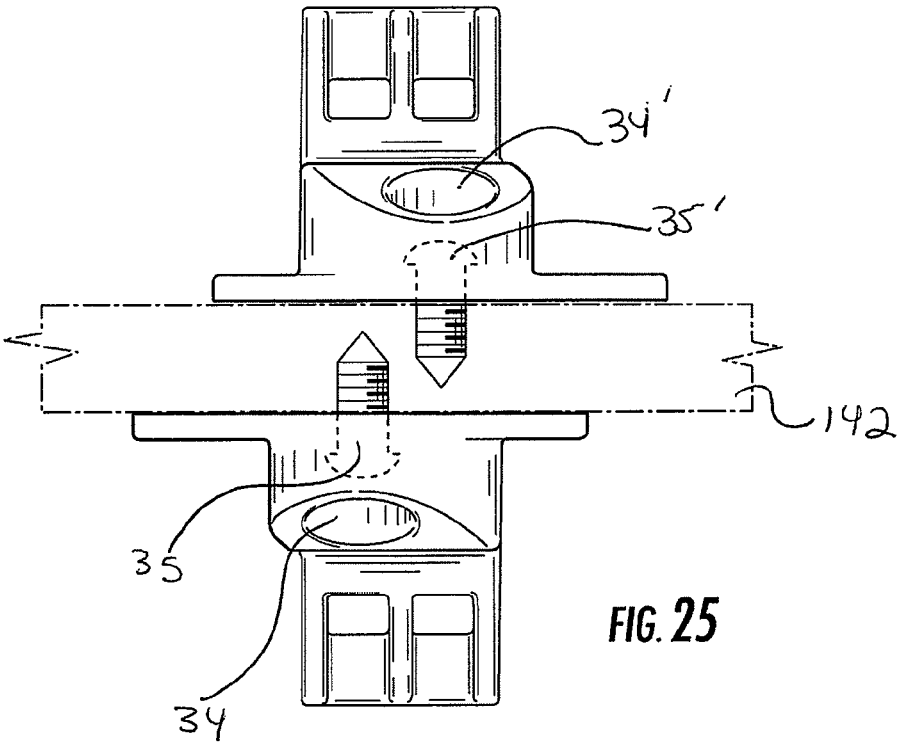
Figure 26:
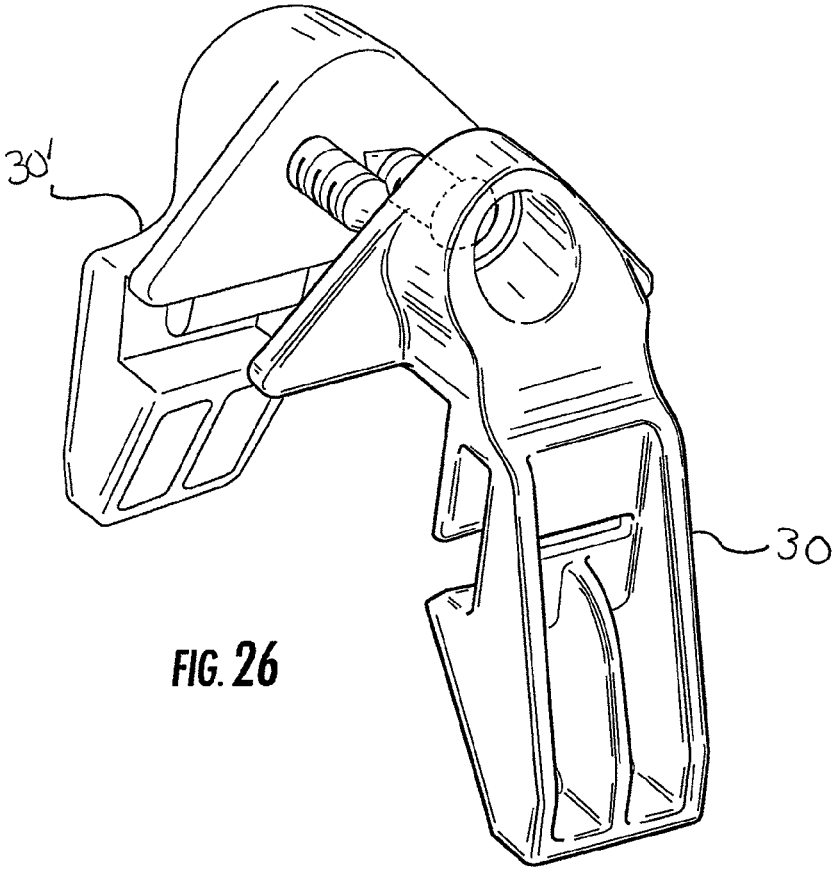

Guide 30 also has hole 34 located on opposite end of aperture 32 and through which fastener 35 passes to fasten guide 30 to frame 16. As shown, center 36 of hole 34 is spaced apart or offset from longitudinal axis 38. In some embodiments, the reason for the offset is for installation purposes where the body or head of fastener 35 bumps or interferes with other structure, such as another window sash, window frame, or parts of a second lock mechanism on a similarly closing window. In other embodiments, the reason for the offset is for installation purposes where the body or head of fastener 35 interferes with the body or head of another fastener (see FIGS. 24-26 which shows dual pivoting windows coming together in a common center 142 and wherein two lock mechanisms 10 are secured to the common center (typically referred to mullion frame in the trade). In a further embodiment, the reason for the offset is for installation purposes where fastener 35 interferes with keeper 40 or fastener 41 used for attaching keeper 40.

Figure 6:
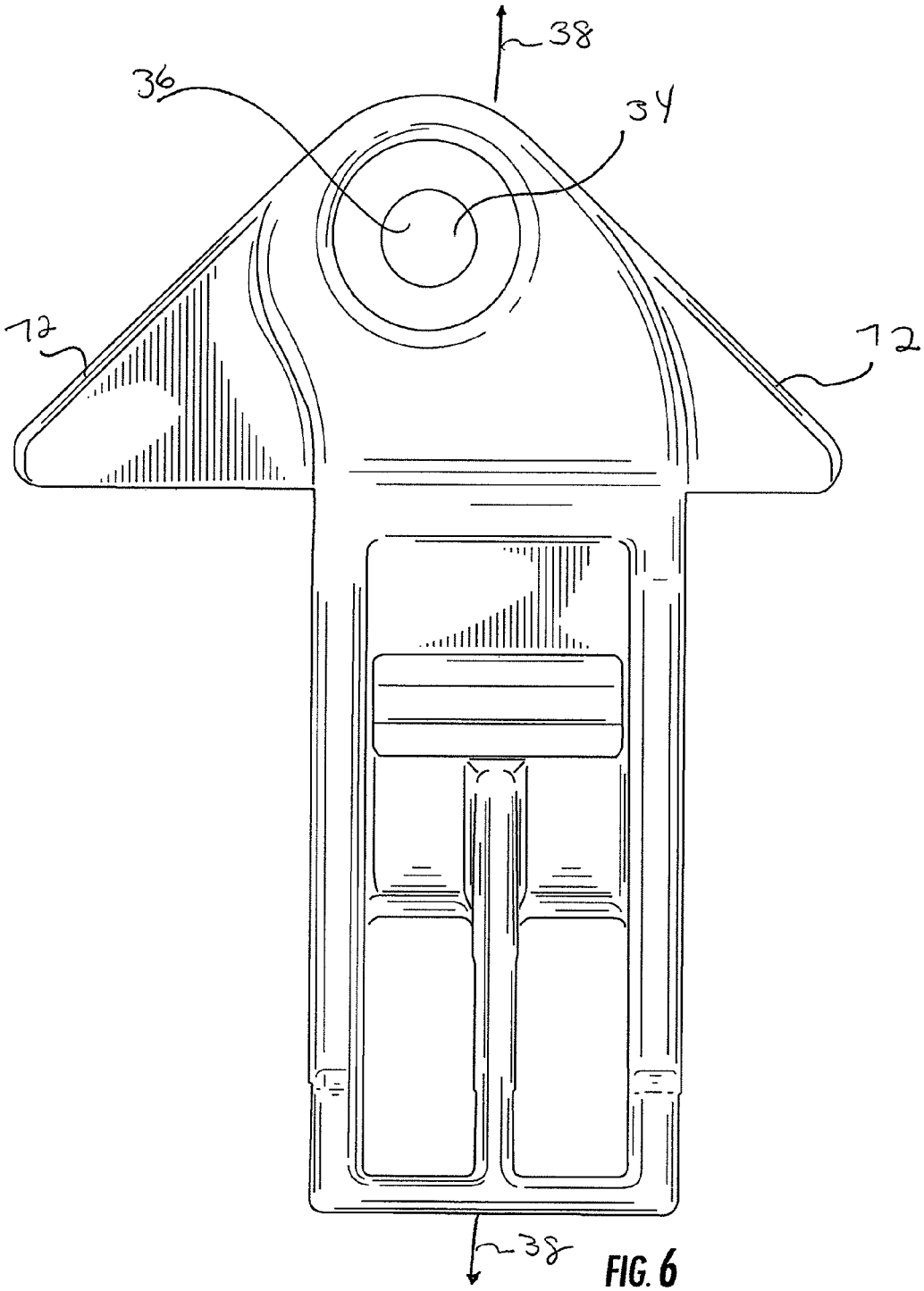

Referring to FIG. 6, guide 30 also includes two wings or stabilizers 72, each extending from hole 34 for inhibiting rotation of guide 30 when rollers 22 are in the process of rolling up ramps 42 to plateaus 44. In some cases, the user needs to exert force upon handle 52 in order to move roller 22 up ramp 42 to plateau 44, wherein such force may cause guide 30 to move away from roller 22. Because guide 30 is fastened to frame 16, guide 30 may tend to rotate away roller 22 and stabilizers 72 inhibit such rotation relative to frame 16.

Figure 7:
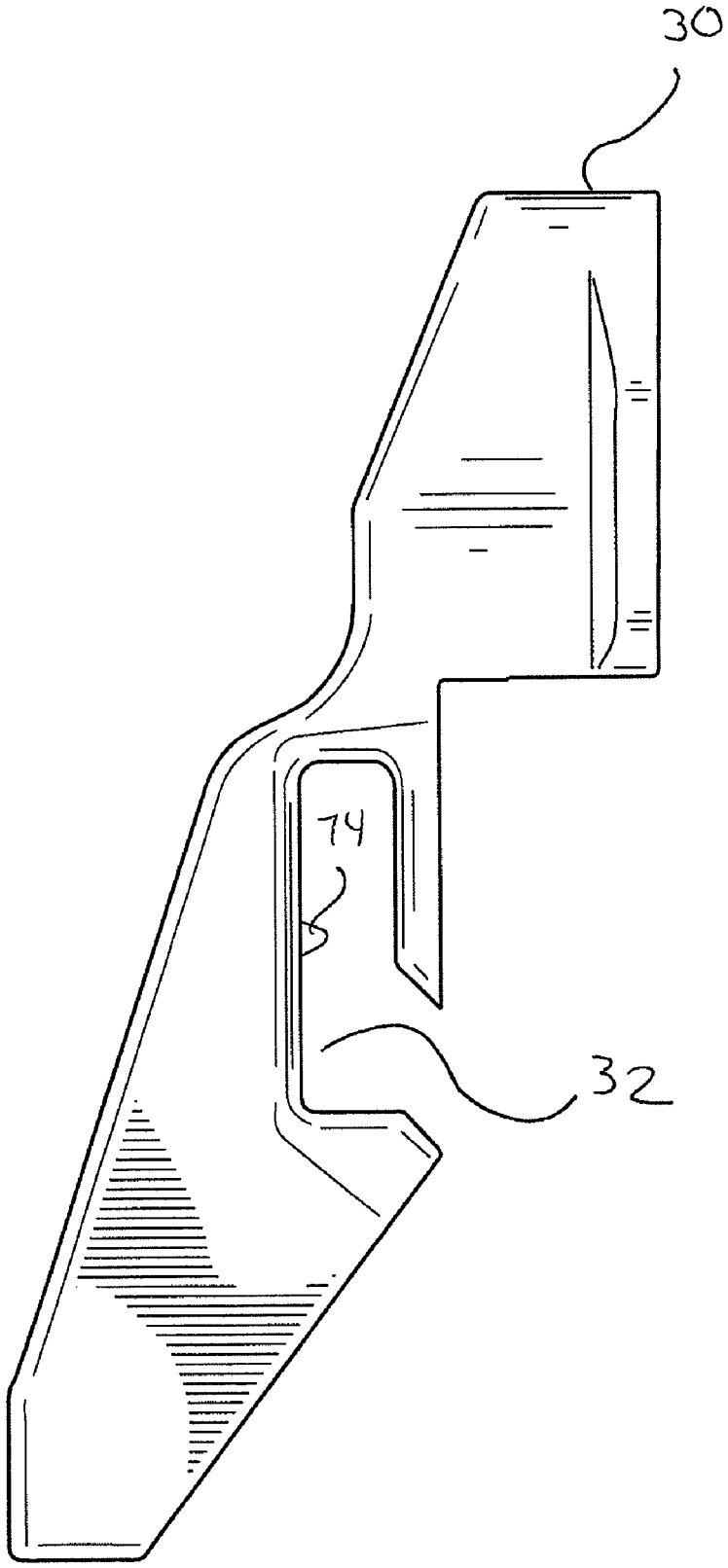

Referring to FIG. 7, aperture 32 includes at least one bump 74 placed within aperture 32 for engaging lockbar 20. Such engagement is particularly helpful during installation of guide 30, lockbar 20, keeper 40, and actuator 50, all of which are linked together and operate in combination with one another so that window 12 may be locked or closed tightly. Therefore, placement of all of these components is important to proper functioning of lock mechanism 10. In this effort, engaging lockbar 20 with aperture 32 by engaging at least one bump 74 with gap 24 (FIG. 4) of lockbar 20 facilitates proper alignment of lockbar 20 relative to guide 30.

It is important to note that continued movement of lockbar 20, typically through operation of lock mechanism 10, will over time wear off bump 74, which is acceptable because the purpose of bump 74 is to facilitate installation. It is also understood that bump 74 typically shears off after more than one operation of lock mechanism 10 or movement of lockbar 20 because adjustment or changes to the positions of lockbar 20, guide 30, and other components of lock mechanism 10 are envisioned and bump 74 should be resistant to wear or shear force or have a fatigue life of more than one cycle to accommodate such adjustments. In some embodiments, bump 74 withstands between approximately 1 and approximately 12 cycles of operations of lock mechanism 10 wherein one operation is defined as window 10 being locked and unlocked. In other embodiments, bump 74 withstands between approximately 12 and 50 cycles.

As shown in FIGS. 9-19, actuator 50 includes fork 55, switch 60, backcase 86, and drive pin 82. Fork 55 has a V shaped groove 54 with first and second legs 56, 58 and opening 59 located at a juncture of first and second legs 56, 58.

Switch 60 is placed within opening 59 and includes channel 62 on a front side and post 64 on an opposite side or backside of switch 60. While placed within opening 59, channel 62 rotates between alignment with first leg 56 and second leg 58 depending upon a location of post 64 within S shaped notch 88. More specifically, as switch 60 moves from first part 90 of notch to third part 94 of notch, channel 62 rotates from alignment with first leg 56 to alignment with second leg 58, respectively. When post 64 is within second part 92, channel 62 is transitioning between first and second legs 56, 58. In another embodiment, channel rotates from alignment with second leg 58 to alignment with first leg 56 as post moves from first part 90 to third part 94, respectively.

The purpose of channel 62 and switch 60 in general is to help ensure proper movement of drive pin 82 within V shaped groove 54. More particularly, channel 62 and alignment with first and second legs 56, 58 ensure that drive pin 82 is placed and slides within the correct leg of V shaped groove 54. For example, if channel 62 is aligned with first leg 56, it is difficult for drive pin 82 to slide or move to or within second leg 58. Conversely, if channel 62 is aligned with second leg 58, it is difficult for drive pin 82 to slide or move to or within first leg 56.

Post 64 being placed within S shaped notch 88 facilitates rotation of switch 60 and therefore also facilitates alignment of channel 62 with first or second legs 56, 58 resulting in drive pin 82 being placed within the correct part of V shaped groove 54.

Referring to FIGS. 3-4 and 11-12, fork 55 also includes a pair of arms 53 for engaging with main roller 26 that is rotatably mounted on lockbar 20, wherein movement of handle 52 causes fork 55 to move and, because of engagement with main roller 26, arms 53 cause main roller 26 and lockbar 20 to move along axis 31 passing through aperture 32.

Figure 9:
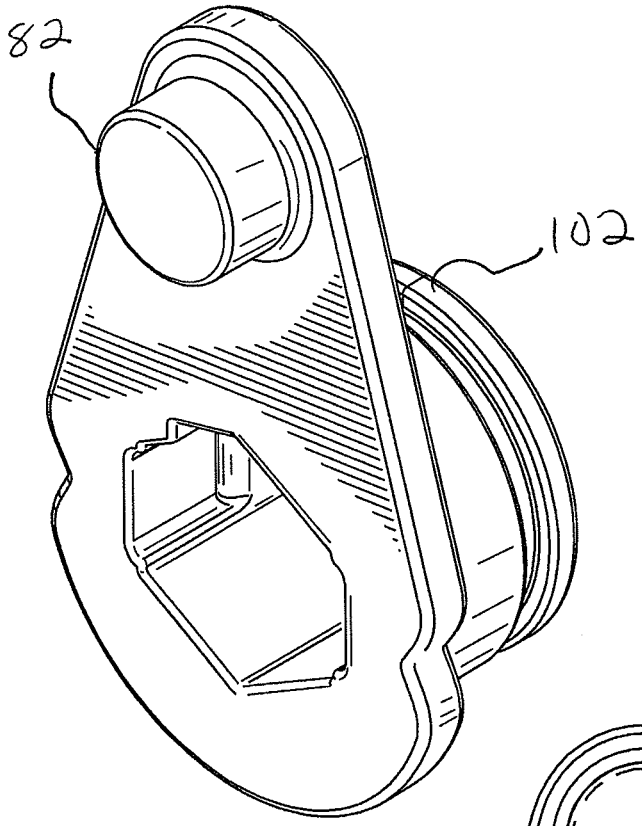
FIGS. 9-19 more particularly depict the actuator shown in FIG. 1.
Figure 10:
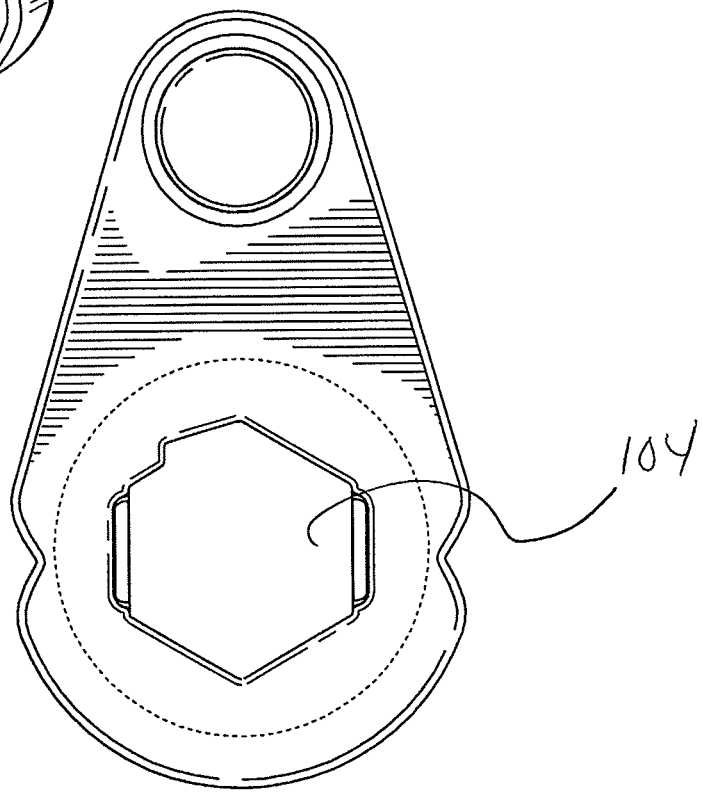
Figure 11:
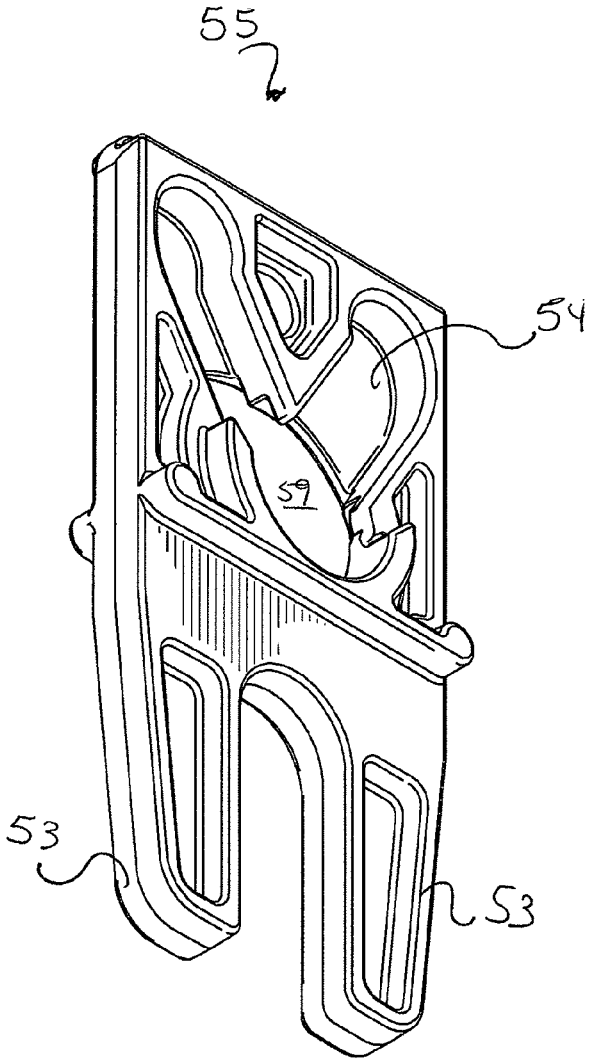
Figure 12:
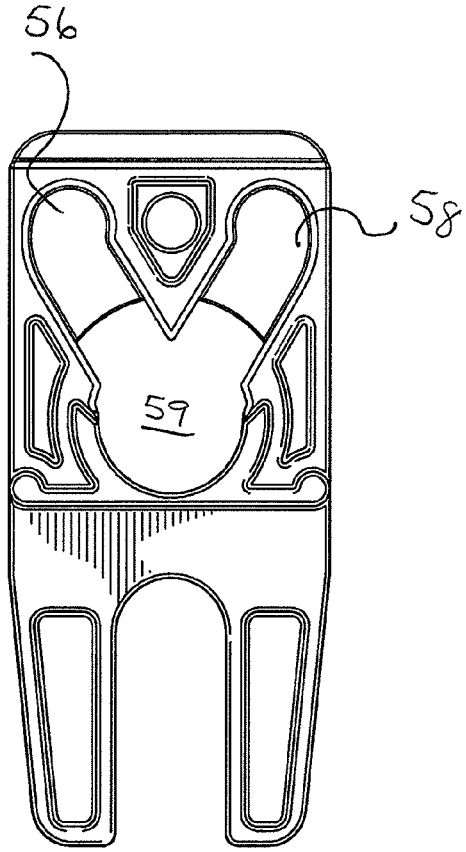
Figure 13:
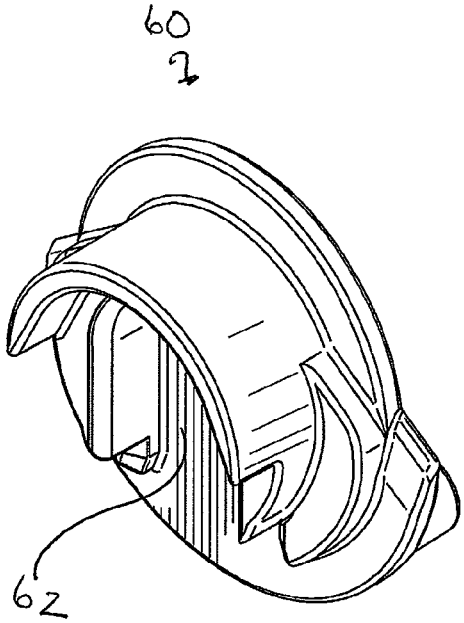
Figure 14:
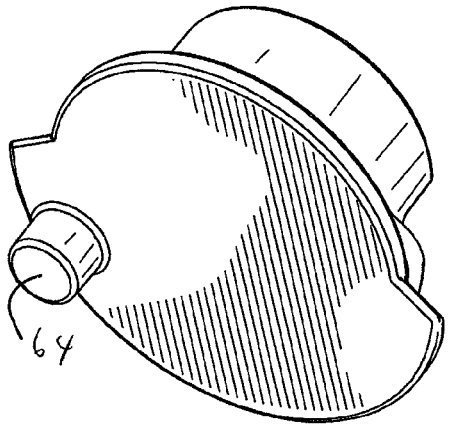
Figure 15:
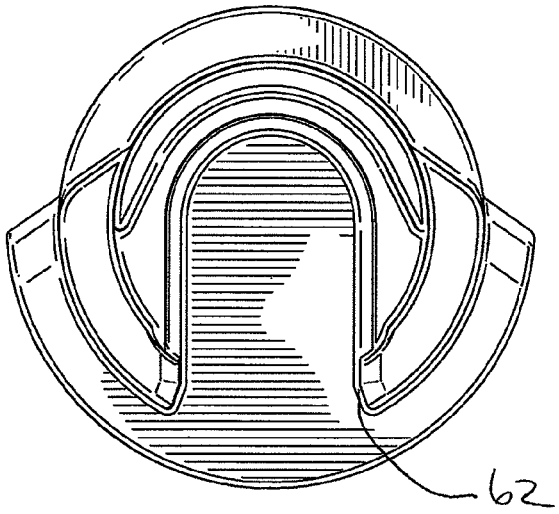
Figure 16:
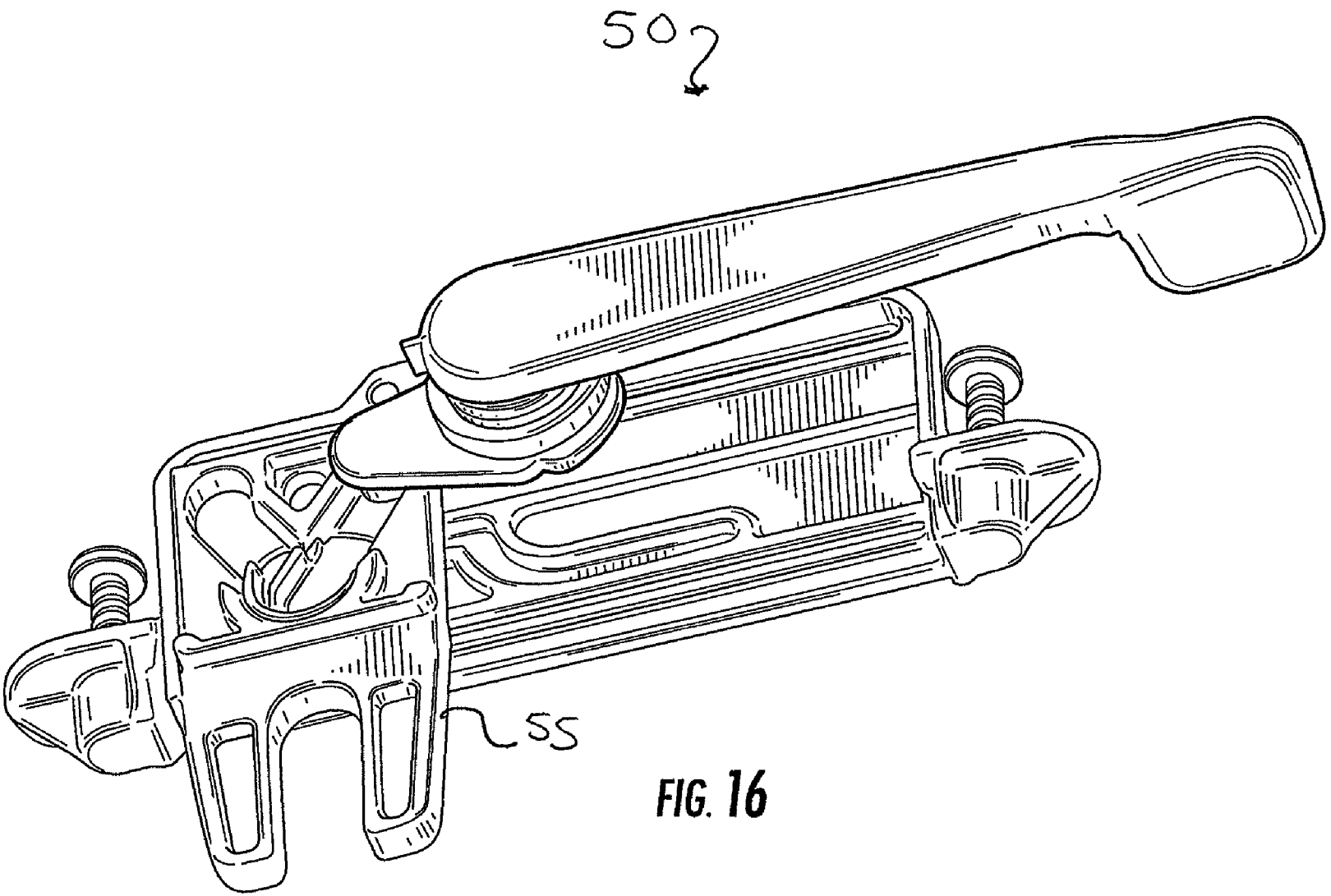
Figure 17A:
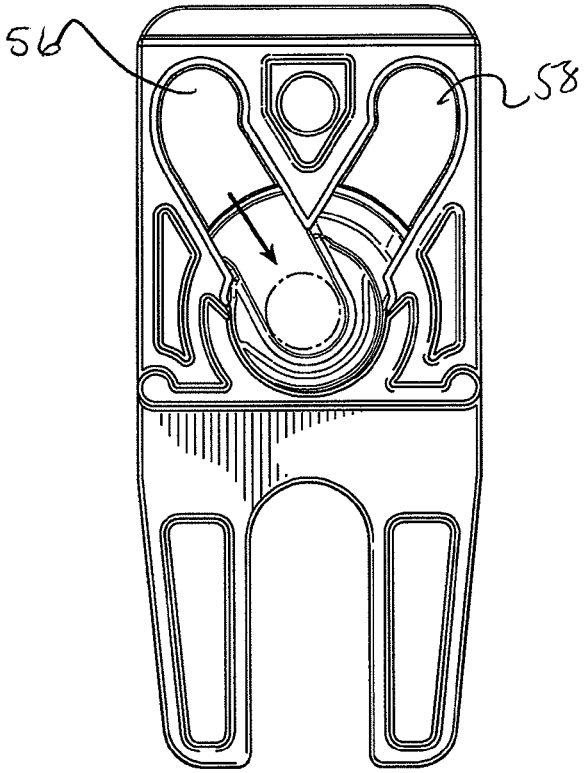
Figure 17B:
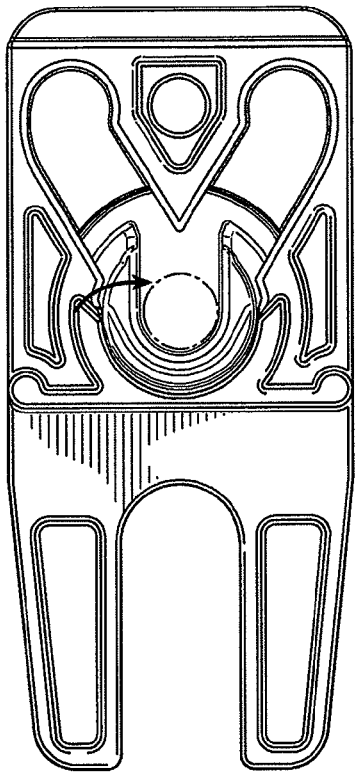
Figure 17C:
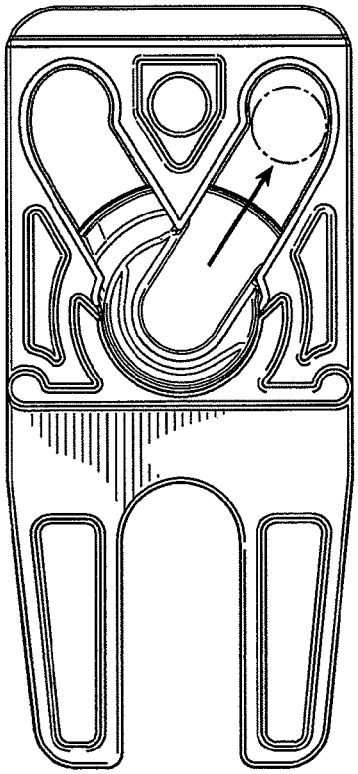

Referring to FIGS. 9-10, actuator 50 is shown more particularly to include hub 102 with polygonal interior 104 that mates with handle 52, where the turning force exerted by the user upon handle 52 is transmitted to hub 102 resulting in hub 102 rotating.

Rotation of hub 52 causes drive pin 82 that is fixed to hub 102 to likewise rotate but since drive pin 82 is placed within V shaped groove 54, as described above, drive pin 82 will travel down first leg 56 toward switch 60. When drive pin 82 moves down first leg 56, fork 55 will likewise move along S shaped notch 88, due to fork 55 being connected to switch 60, in the general direction of the rotation of drive pin 82.

As fork 55 and moving along S shaped notch 88, lockbar 20 is translating or moving linearly through aperture 32. Continued rotation of handle 53 will cause drive pin 82 to be placed within channel 62 and subsequently to move up second leg 58 until lockbar 20 engages with keeper 40, as described above.

As shown herein, drive pin 82 moves within first leg 56, second leg 58, and channel 62 contemporaneously as post 64 moves within S shaped notch 88. Further, a location of post 64 within S shaped notch 88 determines a rotation of switch 60 and a general alignment of channel 62 with first and second legs 56, 58.

Figure 21:
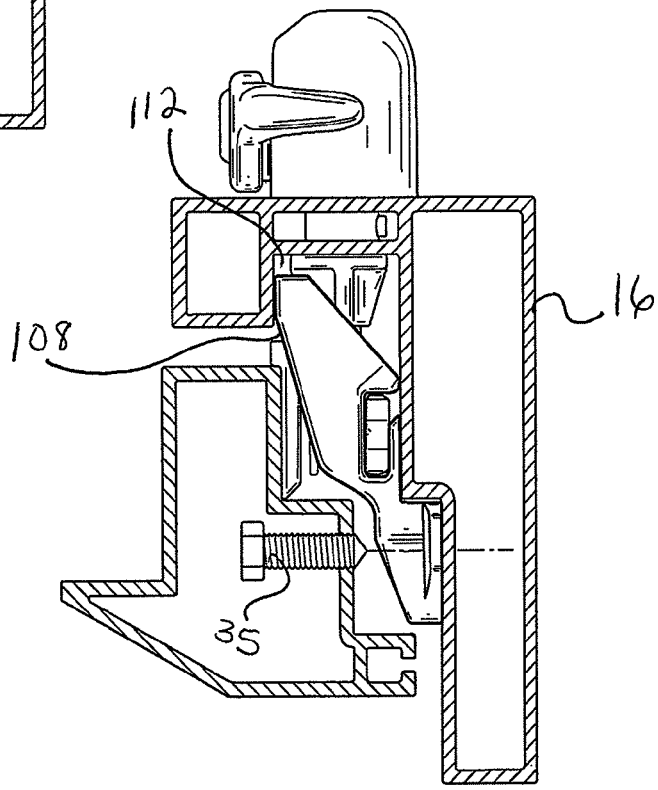

Referring to FIG. 21, some embodiments place or wedge at least one part 108 of guide 30 within a part of or recess 112 of frame 16. In this effort, a single fastener 35 is all that is needed for fastening guide 30 to frame 16. An advantage of minimizing fasteners is that there is less interference between fastener 35 and other components or other fasteners in addition to reduced installation time.

In addition to the foregoing, some embodiments position at least one part 108 snug within recess 112 to reduce movement of guide 30 in a counter-clockwise and clockwise direction shown in FIG. 21 as well as a pivoting or rotational movement about an axis generally parallel to longitudinal axis 38, which functions similar to at least one stabilizer 72. In these embodiments, the reduced movement enhances the strength of guide 30 and the strength of the attachment of guide 30 to frame 16. In a further embodiment, should guide 30 not fit snug within recess 112, guide 30 and/or fastener 35 may come loose from frame 16. As shown, there is generally a 1 mil clearance between guide 30 and frame 16 in any direction. In some embodiments, the clearance is between approximately 1 mil and approximately 3 mils. In other embodiments, the clearance is between approximately 0 mil and 1 mil. In a further embodiment, there is an interference fit between guide 30 and frame 16.

In the embodiment shown, cover 114 is snapped on near the end of installation after lock bar 20, guide 30, and other components of actuator 50 are installed. In some embodiments, a plurality of covers are provided and each cover is interchangeable with a next cover. This is particularly helpful when choosing a color to match a décor of a room. In further embodiments, cover 114 is applied by the user or consumer after installation so that a color may be chosen and the cover with the chosen color is applied or snapped on. In another embodiment, the plurality of covers are given to the user or consumer and from which the user or consumer picks one to snap on or apply.

In another aspect of the invention, handle 52 is snapped on after cover 114. For the same reasons as cover 114, handle 52 is interchangeable with a plurality of other handles and the user or consumer chooses one handle based on color or shape of handle 52. In some embodiments, both a plurality of covers and plurality of handles are given to the user or consumer after all other components are already installed, from which the user or consumer picks one cover and one handle to complete the installation. This is helpful for preserving the condition of handle 52 and cover 114 because these components typically are most visible after installation is completed.

Figure 18:
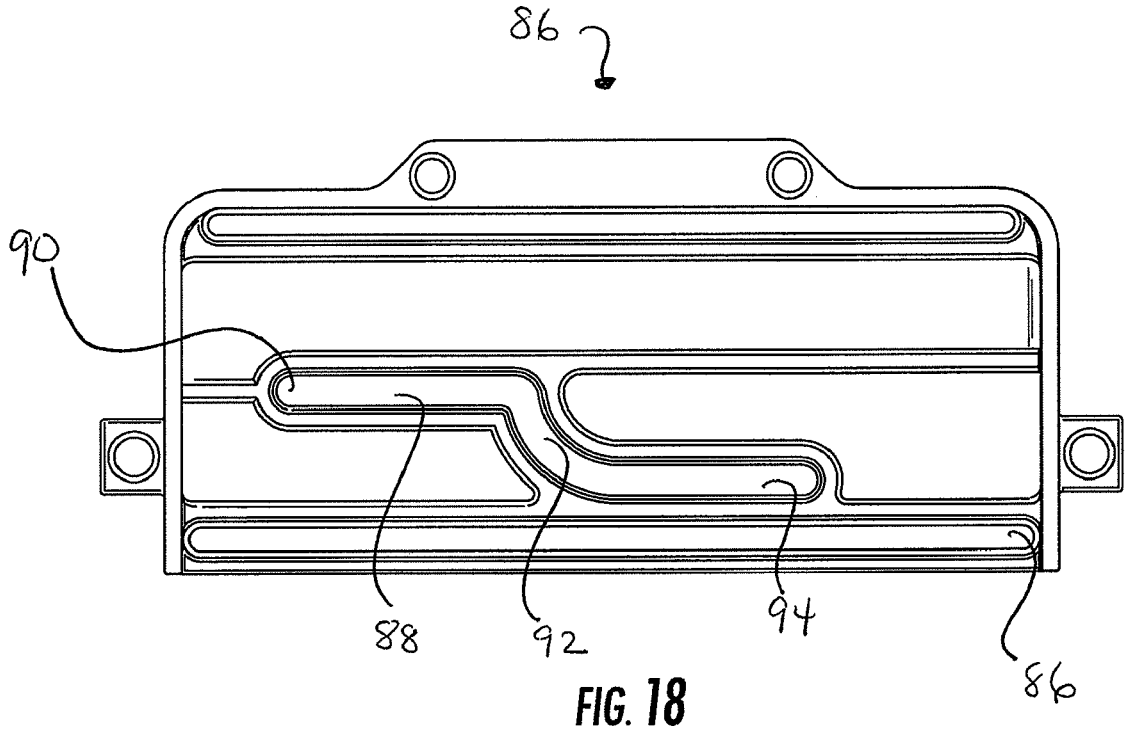
Figure 19:
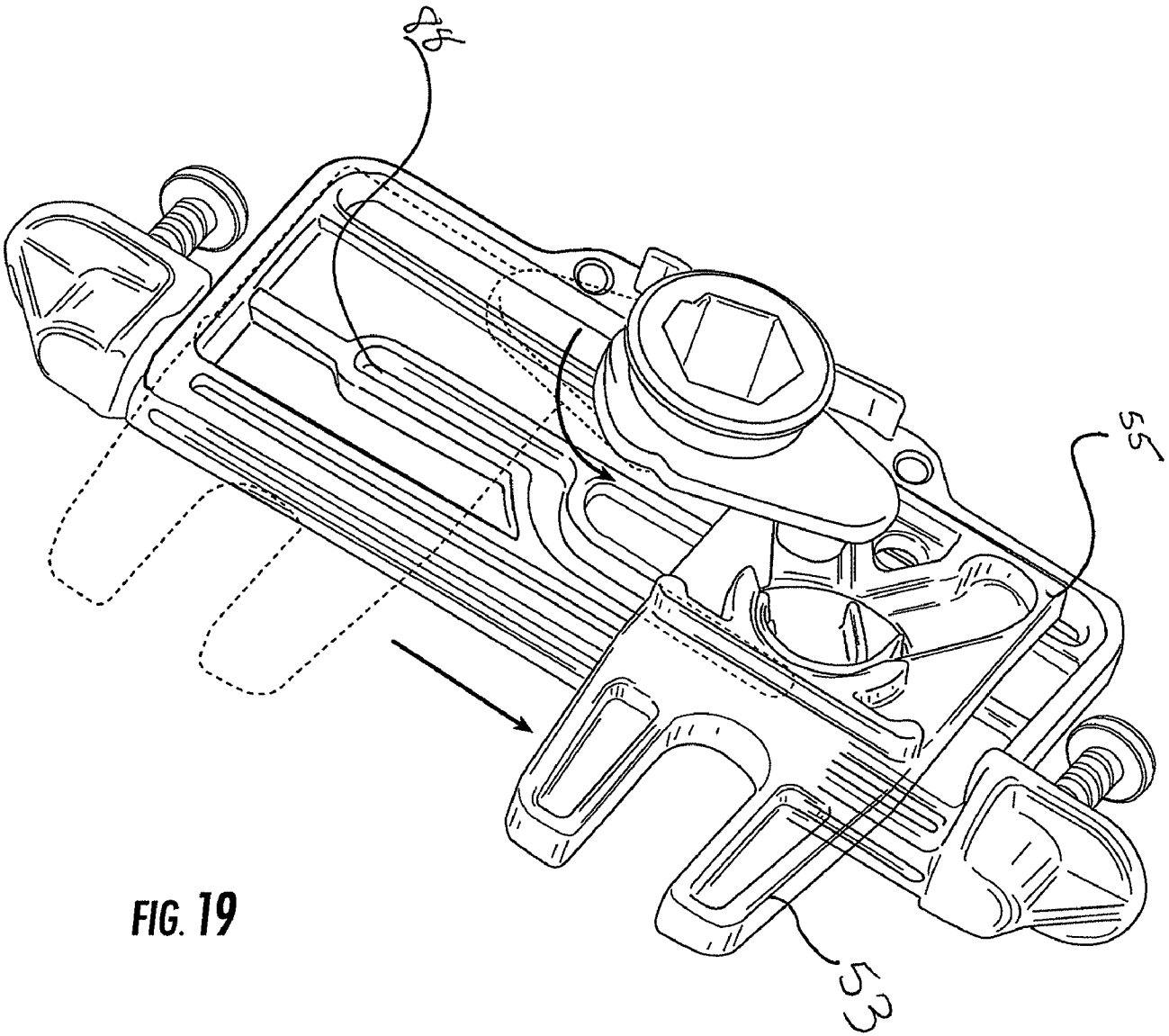
Figure 20:
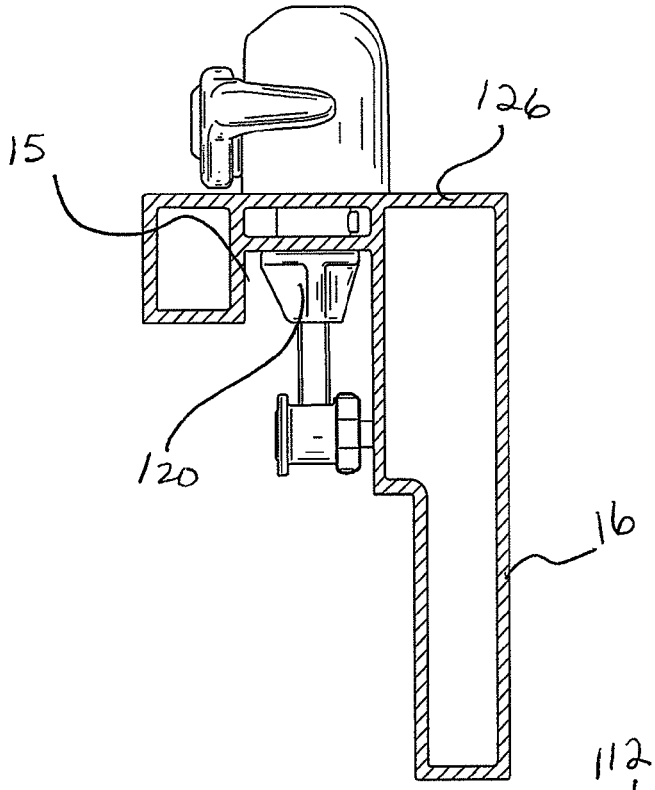
FIGS. 20-21 depict a side view of the lock mechanism shown in FIG. 1.
Figure 22:
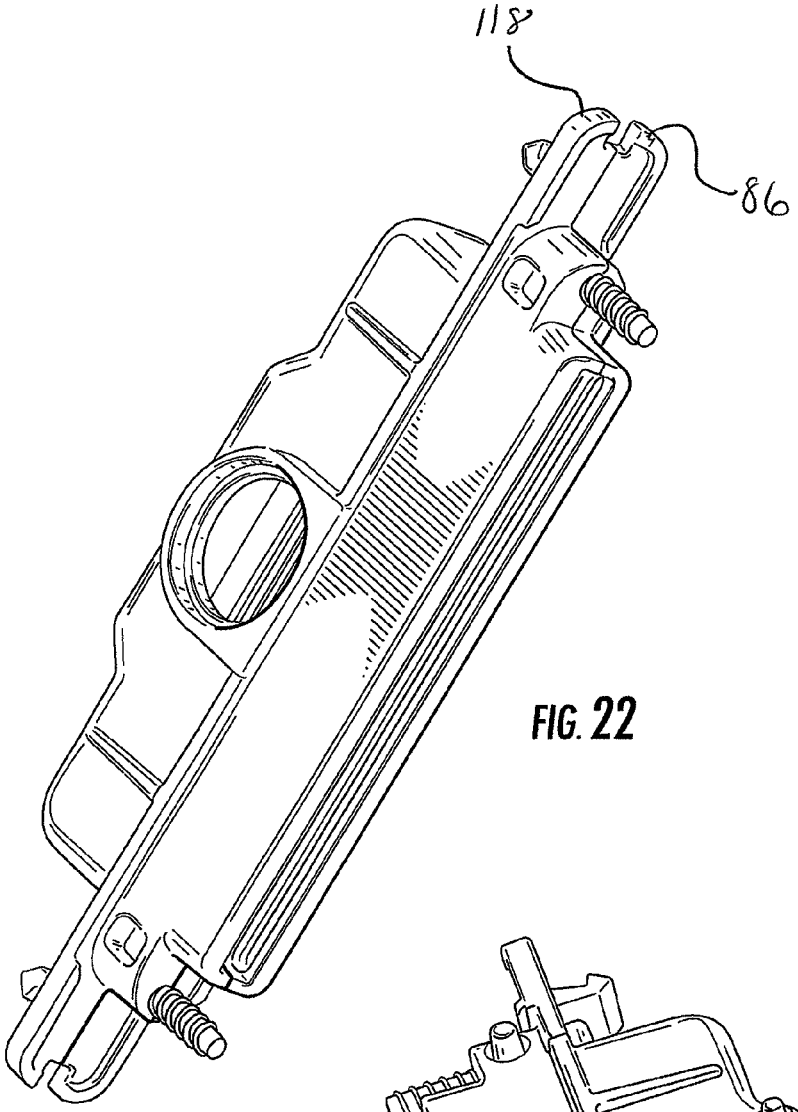
FIGS. 22-23 more particularly depict the covers for the actuator shown in FIG. 1.
Figure 23:
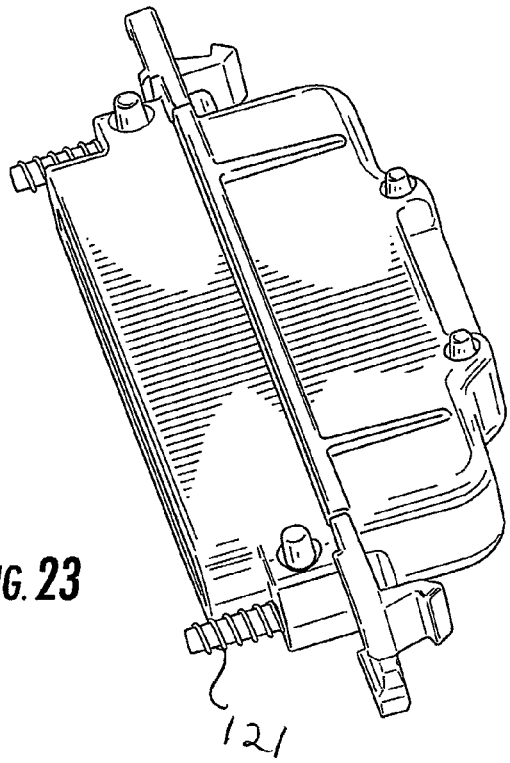

As shown in FIG. 18, S shaped notch 88 is located on back case 86, which is fastened to frame via attachment to front case 118 and retainer 120, (FIGS. 20, 22, and 23) where fasteners 121 are used to secure front case 118 to retainer 120. As shown, retainer 120 is placed within recess 15 of frame 16 and handle 52 is located on outside 126 of frame 16. Also as shown, fasteners 121 are threaded toward retainer 120. In another embodiment, depending upon a user preference, fasteners 121 are inserted through retainer 120 toward handle 52. Permitting fasteners 121 to be applied in either direction to secure retainer 120, front case 118, and back case 86 facilitates installation.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

The invention claimed is:

1. A lock mechanism for a casement window, comprising:

a keeper adapted to be attached to a sash;

a lockbar adapted to be attached to a frame for engaging with said keeper to lock the casement window;

an actuator for actuating said lockbar to engage with said keeper;

said actuator includes a fork having a V shaped groove, said V shaped groove includes a first leg and a second leg;

said actuator includes a switch having a channel for placement of a drive pin; and said switch being rotatably mounted at a juncture of said first and second legs so that said channel generally aligns with either said first leg or said second leg for facilitating alignment of said drive pin within said V shaped groove.

2. The lock mechanism according to claim 1, wherein said actuator further includes a back case having an S shaped notch;

said switch further includes a post on a side of said switch opposite said channel, said post being placed within said S shaped notch;

wherein said drive pin moves within said V shaped groove and said channel contemporaneously as said post moves within said S shaped notch; and wherein a location of said post within said S shaped notch determines a rotation of said switch and a general alignment of said channel with said first leg and said second leg.

3. The lock mechanism according to claim 1, further comprising a guide having an aperture through which said lockbar passes for facilitating engagement of said lockbar with said keeper;

said guide having a hole through which a fastener passes to fasten said guide to the frame; and said guide also having a longitudinal axis that is spaced apart from a center of said hole.

4. The lock mechanism according to claim 3, wherein said guide further comprises at least one stabilizer extending from said hole for inhibiting rotation of said guide.

5. The lock mechanism according to claim 3, wherein said aperture further comprises at least one bump for engaging said lockbar.

6. The lock mechanism according to claim 1, wherein said keeper has at least one ramp for engaging with said lockbar.

7. A lock mechanism for a casement window, comprising:

a keeper adapted to be attached to a sash;

a lockbar adapted to be attached to a frame for engaging with said keeper to lock the casement window;

a guide having an aperture through which said lockbar passes for facilitating engagement of said lockbar with said keeper;

said guide having at least one hole through which a fastener passes to fasten said guide to the frame, said guide also having a longitudinal axis that is offset from a center of each of said at least one holes such that said guide is not symmetrical about any of said at least one holes and said guide is adapted to be installed on a window frame, including on either side of a mullion window frame, whereby when two of said guides are installed on opposite sides of a mullion window frame with the longitudinal axes of the two guides aligned, the respective centers of said at least one holes of the two of said guides are offset in opposite directions to prevent interference between fasteners installed in all of said at least one holes of the two of said guides;

an actuator for actuating said lockbar to engage with said keeper;

said actuator includes a fork, a switch, and a drive pin;

said fork has a V shaped groove, said V shaped groove includes a first leg and a second leg;

said switch includes a channel for placement of said drive pin; and said switch being rotatably mounted at a juncture of said first and second legs so that said channel generally aligns with either said first leg or said second leg depending upon a rotation of said switch.

8. The lock mechanism according to claim 7, wherein said actuator also includes a back case having an S shaped notch;

said switch further includes a post on a side of said switch opposite said channel, said post being placed within said S shaped notch;

wherein said drive pin moves within said first leg, second leg, and channel contemporaneously as said post moves within said S shaped notch; and wherein a location of said post within said S shaped notch determines a rotation of said switch and a general alignment of said channel with said first leg and said second leg.

9. The lock mechanism according to claim 7, further comprising a plurality of covers for covering at least said actuator, and wherein each cover is interchangeable with a next cover.

10. A lock mechanism for a casement window, comprising:

a keeper adapted to be attached to a sash;

a lockbar adapted to be attached to a frame for engaging with said keeper to lock the casement window;

a guide for facilitating engagement of said lockbar with said keeper and having a hole through which a fastener passes to fasten said guide to the frame;

said guide also having a longitudinal axis that is spaced apart from a center of said hole;

an actuator for actuating said lockbar to engage with said keeper;

said actuator includes a fork having a V shaped groove, said V shaped groove includes a first leg and a second leg;

said actuator includes a switch having a channel for placement of a drive pin;

said switch being rotatably mounted at a juncture of said first and second legs so that said channel generally aligns with either said first leg or said second leg depending upon a rotation of said switch;

said actuator includes an S shaped notch;

said switch further includes a post on a side of said switch opposite said channel, said post being placed within said S shaped notch;

wherein said drive pin moves within said first leg, second leg, and channel contemporaneously as said post moves within said S shaped notch; and wherein a location of said post within said S shaped notch determines a rotation of said switch and a general alignment of said channel with said first leg and said second leg.

11. The lock mechanism according to claim 10, wherein guide is secured with a single fastener.

12. The lock mechanism according to claim 11, wherein the window frame includes a recess in which a part of said guide is placed and wherein said single fastener secures another part of said guide.

13. The lock mechanism according to claim 10, further comprising a plurality of covers, each being interchangeable with a next for covering said actuator and each having a varying physical characteristic than a next cover.

14. The lock mechanism according to claim 10, further comprising a plurality of handles, each being interchangeable with a next for actuating said actuator and each having a varying physical characteristic than a next handle.

* * * * *